US006782848B2

(12) United States Patent
Kinni

(10) Patent No.: US 6,782,848 B2
(45) Date of Patent: Aug. 31, 2004

(54) METHOD IN CONNECTION WITH A PIPE GRATE FOR FLUIDIZED BED BOILER AND A PIPE GRATE

(75) Inventor: Jouni Kinni, Tampere (FI)

(73) Assignee: Kvaerner Power Oy, Tampere (FI)

( * ) Notice: Subject to any disclaimer, the term of this patent is extended or adjusted under 35 U.S.C. 154(b) by 0 days.

(21) Appl. No.: 10/388,416

(22) Filed: Mar. 17, 2003

(65) Prior Publication Data

US 2003/0170582 A1 Sep. 11, 2003

Related U.S. Application Data

(63) Continuation of application No. 09/868,856, filed on Jun. 21, 2001, now Pat. No. 6,571,746.

(30) Foreign Application Priority Data

Jan. 21, 1999 (FI) ..... 990113

(51) Int. Cl.[7] ..... F28D 13/00; F27B 15/16

(52) U.S. Cl. ..... 122/4 D; 165/104.16; 432/58

(58) Field of Search ..... 122/4 D; 110/245; 432/58; 165/104.16, 104.18

(56) References Cited

U.S. PATENT DOCUMENTS 4,240,364 A * 12/1980 Bryers et al. ..... 110/347
4,349,969 A * 9/1982 Stewart et al. ..... 34/579
4,453,494 A 6/1984 Waryasz
4,648,330 A 3/1987 Delebarre
4,694,758 A * 9/1987 Gorzegno et al. ..... 110/347
4,753,180 A 6/1988 Narisoko et al.
4,758,154 A * 7/1988 Branders ..... 432/58
4,809,620 A * 3/1989 Cosar ..... 110/263
5,743,197 A * 4/1998 Kinni et al. ..... 110/245
5,966,839 A 10/1999 Pohja et al.
6,263,837 B1 * 7/2001 Utunen et al. ..... 122/4 D

FOREIGN PATENT DOCUMENTS

| | | |
|---|---|---|
| AT | 385109 | 2/1988 |
| EP | 0064911 | 11/1982 |
| EP | 0443850 | 8/1991 |
| WO | WO 95/26483 | 10/1998 |

* cited by examiner

*Primary Examiner*—Gregory A. Wilson
(74) *Attorney, Agent, or Firm*—Venable LLP; Eric J. Franklin

(57) ABSTRACT

A method for adjusting a supply of gaseous medium to a fluidized bed boiler performing a combustion process and including a pipe grate comprising a plurality of pipes. An active area of the pipe grate is adjusted to form at least one inactive bed area that is out of use by shutting off the supply of gaseous medium to some of the pipes of the pipe grate utilizing pipe-specific control means included in at least some of the pipes of the pipe grate. Cooling medium is conducted through cooling channels located in the pipes in the at least one inactive bed area at least during the combustion process.

12 Claims, 8 Drawing Sheets

METHOD IN CONNECTION WITH A PIPE GRATE FOR FLUIDIZED BED BOILER AND A PIPE GRATE

CROSS-REFERENCE TO RELATED APPLICATIONS

This application is a continuation of U.S. patent application Ser. No. 09/868,856, filed Jun. 21, 2001 now U.S. Pat. No. 6,571,746.

FIELD OF THE INVENTION

The invention relates to a method in connection with a pipe grate for a fluidized bed boiler and to a pipe grate.

BACKGROUND OF THE INVENTION

A grate assembly for a fluidized bed boiler comprising parallel sparge pipes or the like is known e.g. from Finnish publication print 98405, to which corresponds U.S. Pat. No. 5,743,197, as well as from Finnish patent application 961653. In a way typical for such pipe grates, fluidizing air is supplied through cooled sparge pipes so that it is discharged upwards from nozzles located at determined intervals in the longitudinal direction of the sparge pipes, to effect fluidization. The fluidizing air also constitutes the combustion air to effect combustion in a fuel admixed to the fluidized bed material.

It is precisely variations in the fuels that have caused a problem in the design of fluidized bed boilers that the surface area of the grate at the bottom of the fluidized bed boiler, i.e. the horizontal cross-sectional area of the fluidized bed boiler must be dimensioned according to the poorest fuel and a full load. Thus, the horizontal cross-sectional area is too large when the heating value of the fuel is better than with the fuel used for the dimensioning. Similarly, the area is too large with partial loads. An unnecessarily large cross-sectional area will result in the use of extra circulation gas to control the temperature of the bed with dry fuels. Also, the minimum load of the boiler is determined according to the cross-section, because if the load is small, the temperature of the bed will decrease to a level which is too low.

Attempts have been made to solve the above-presented drawbacks in fluidized bed boilers equipped with a so-called wind box in such a way that the wind box placed under the grate is divided in two parts, for example by dividing it in two halves by the middle or by making, in a way, two boxes within each other, wherein the cross-section of the bottom, or the grate, can be divided into a central area and an edge zone. This structural solution is expensive, and the separate wind boxes require air measurements and adjustments of their own. For this reason, divided wind boxes are eliminated in new fluidized bed boilers based on a wind box.

Finnish patent application 970559, to which corresponds international publication WO 95/26483, presents a method for removing fluidized zones in connection with a PFBC power plant for the purpose of controlling the active heat transfer area of pipes in a steam generator. This is accomplished with shelf-like baffle plates which are moved in the vicinity of the walls of the combustion chamber, above the nozzles supplying fluidizing air. It is mentioned in the application that to improve the blocking effect of the baffle plates, it is possible to close the air supply from the fluidizing nozzles underneath. In the structure presented in the application, the nozzles are separate fluidizing nozzles connected to pressurized air in a pressure vessel, and it does not mention how the air supply through certain nozzles can be turned off. The shelf-like baffle plate which is primarily used in the adjustment is a massive structure which requires reconstruction work in the walls of the furnace.

SUMMARY OF THE INVENTION

It is an aim of the invention to eliminate the above-mentioned drawbacks and to present a method in connection with the grate assembly of a fluidized bed boiler, whereby the area of the air supply can be changed in a simple manner without operations in the space above the grate and whereby the adjustment can be effected more precisely than with wind box solutions. To achieve these aims, the method is characterized as described below. In at least some of the pipes of the pipe grate, the supply of fluidizing air to the pipe is controlled in a pipe-specific manner. The pipe grate, in turn, is also characterized as described below. In the pipe grate, at least some of the pipes in the grate have a pipe-specific control means acting on at least part of the supply of air to the pipes. The control means is used to shut off the supply of fluidizing air to the pipe, and such control means are preferably provided in at least the outermost pipes of the grate, i.e. the pipes close to the side wall of the boiler. The control means can also be a partition wall inside the pipe, dividing the pipe in the longitudinal direction in two different sections each with a separate air supply.

According to further advantageous embodiments of the invention, the grate can be divided, for example, in zones extending parallel or perpendicular to the pipes.

BRIEF DESCRIPTION OF THE DRAWINGS

In the following, the invention will be described in more detail with reference to the appended drawings, in which.

DETAILED DESCRIPTION OF PREFERRED EMBODIMENTS

Figure 2:
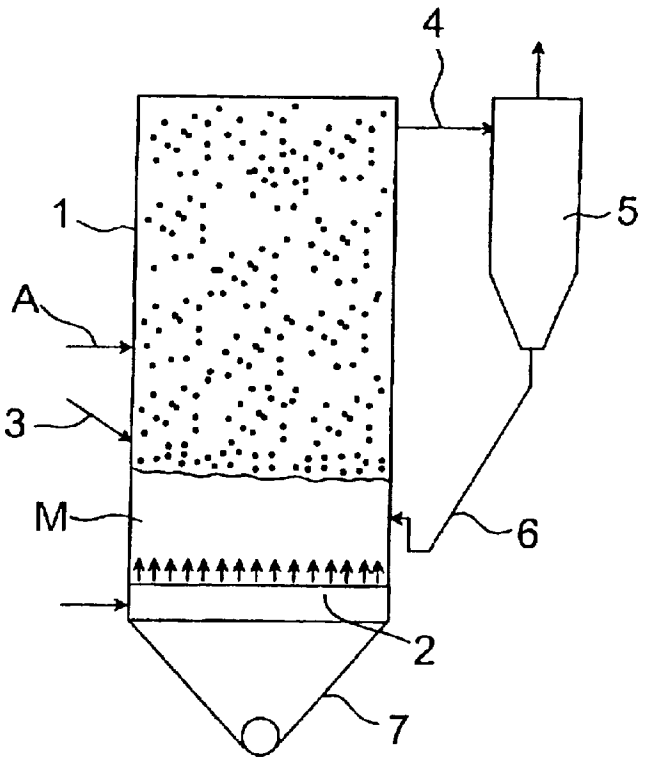
FIGS. 1 and 2 illustrate, in schematic views, fluidized bed boilers in which the pipe grate of the invention can be used.
Figure 1:
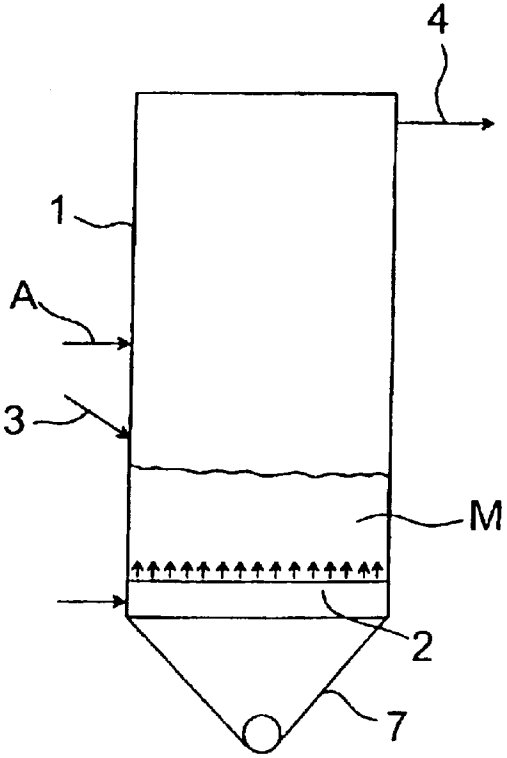

FIGS. 1 and 2 show a fluidized bed boiler with a furnace, i.e. a combustion chamber 1, which is limited from below by a grate 2 used as a structure distributing fluidizing air and combustion air and having pipes and nozzles, as will be described below. By the effect of an air flow directed upwards from the nozzles, bed material M consisting of inert solid particles in the chamber is brought to a fluidized state to form a fluidized bed in which combustion takes place. Fuel is supplied to the fluidized bed from an inlet 3. Exhaust gases are discharged through an outlet 4 in the upper part of the chamber. Additional combustion air A is introduced from one or more levels.

FIG. 1 shows a bubbling fluidized bed (BFB), and FIG. 2 shows a circulating fluidized bed (CFB). In the latter, the bed material is circulated so that solids flown with exhaust gases are separated in a particle separator 5, from which they can be returned to the combustion chamber 1, close to its bottom, via a return duct 6. Each reactor type comprises a fluidized bed material collecting unit 7 underneath the grate 2.

The fluidized bed boilers according to FIGS. 1 and 2 are used in the combustion of solid fuels. The walls of the reactor chamber, i.e. the combustion chamber, are thus equipped with heat transfer tubes to transfer combustion heat to a heat transfer medium flowing in the tubes.

The above-mentioned figures show simplified views of the fluidized bed reactor, and they are only intended to illustrate the operational environment of a pipe grate according to the invention.

Figure 3:
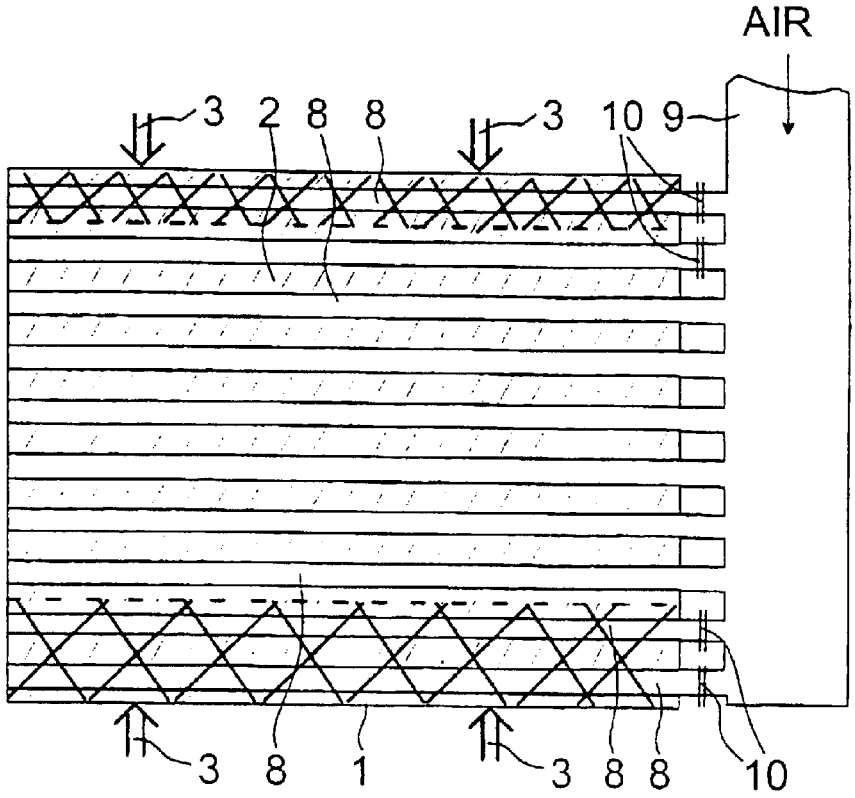
FIGS. 3 and 4 illustrate the grate and its adjustment in schematic views from above and from the side.
Figure 4:
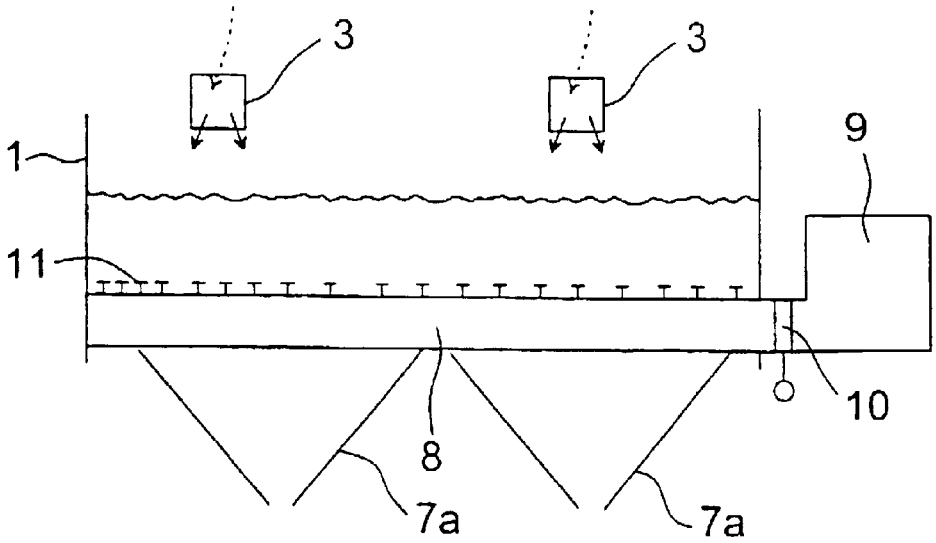

FIGS. 3 and 4 show a first embodiment of the pipe or beam grate according to the invention. FIG. 3 shows the fluidized bed boiler in a horizontal cross-section of the combustion chamber 1; that is, the grate 2 is illustrated from above. In FIG. 1, the direction of supplying the fuel and the location of inlets 3 are indicated with arrows. The grate 2 comprises parallel pipes or beams 8 along which combustion air is supplied to the grate, the air flowing from the pipes upwards to a furnace above the pipe grate. The combustion air is also used as fluidizing air. The air is supplied from a common air duct 9 which is located transversely to the pipes 8 at the ends of them. In FIG. 3, the two pipes closest to the side walls at each edge are equipped with a control means 10, by means of which the connection between the air duct 9 and the respective pipe 8 can be closed and opened. The control means 10 is located between the air duct 9 and the grate 2 at the initial end of the pipe 8 in a part which is outside the grate. FIG. 3 shows how both control means 10 are closed at one edge and only the control means 10 in the outermost pipe 8 is closed at the other edge, wherein the effective area of the grate 2 (the area on which fluidizing and combustion air flows up into the chamber) is reduced for the part of the inactive area marked with a diamond pattern. It is also possible to close both control means 10 at the opposite edge, wherein the area is symmetrically reduced.

Furthermore, FIG. 3 shows how the fuel is supplied transversely to the direction of the pipes 8, wherein it flies over the inactive areas to the fluidized bed in the middle.

FIG. 4 also shows nozzles 11 which are placed at certain intervals in the longitudinal direction of the pipes and from which the combustion and fluidizing air is discharged up to the chamber and the fluidized bed.

Further, FIG. 4 shows two feed orifices in the side walls of the chamber which are used as inlets 3 for supplying the fuel. A collecting unit 7 underneath the grate comprises parallel collecting funnels 7*a* to receive and discharge material flowing between the pipes 8 from the furnace.

Figure 5:
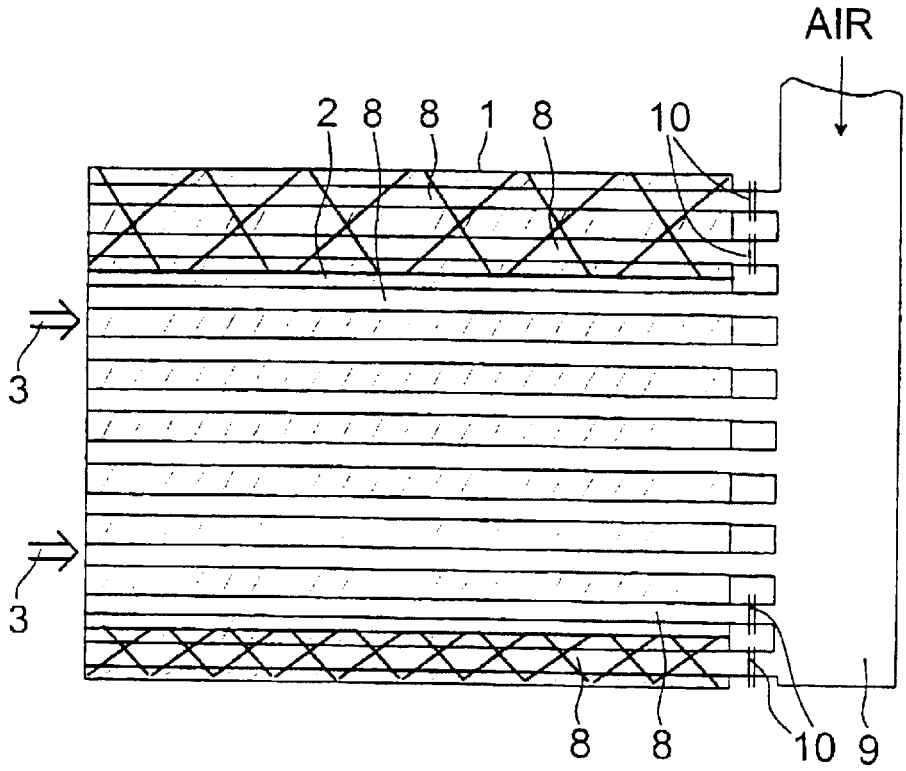
FIGS. 5 and 6 illustrate a second embodiment of the grate and its adjustment seen from above and from the side.
Figure 6:
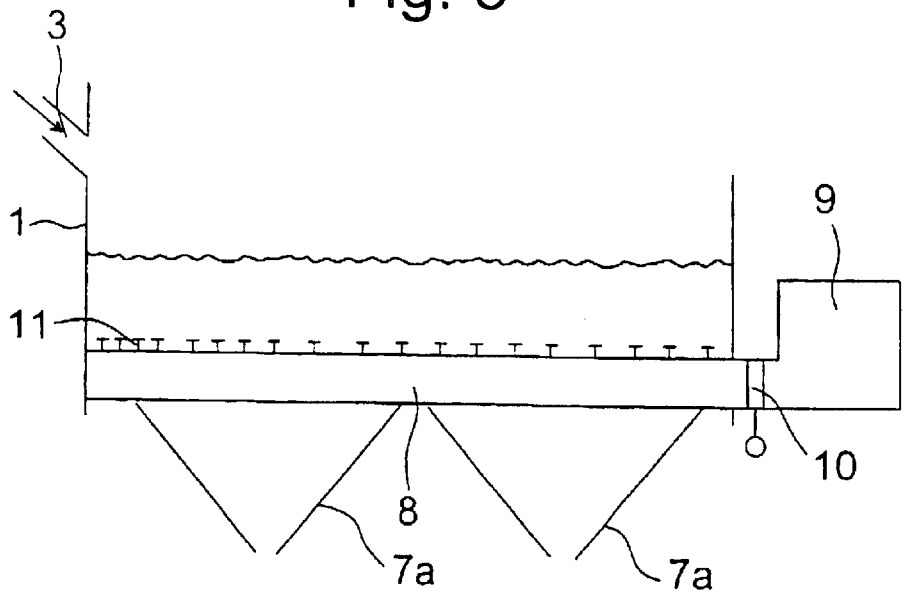

FIGS. 5 and 6 show an embodiment with a similar control arrangement as in FIGS. 3 and 4, but here the fuel is supplied in the direction of the pipes 8, i.e. from an inlet 3 opening in a chamber wall transverse to the longitudinal direction of the pipes. The inlets, of which two parallel inlets are shown in FIG. 5, are located in the area where the air supply to the pipes 8 is not cut off.

Figure 7:
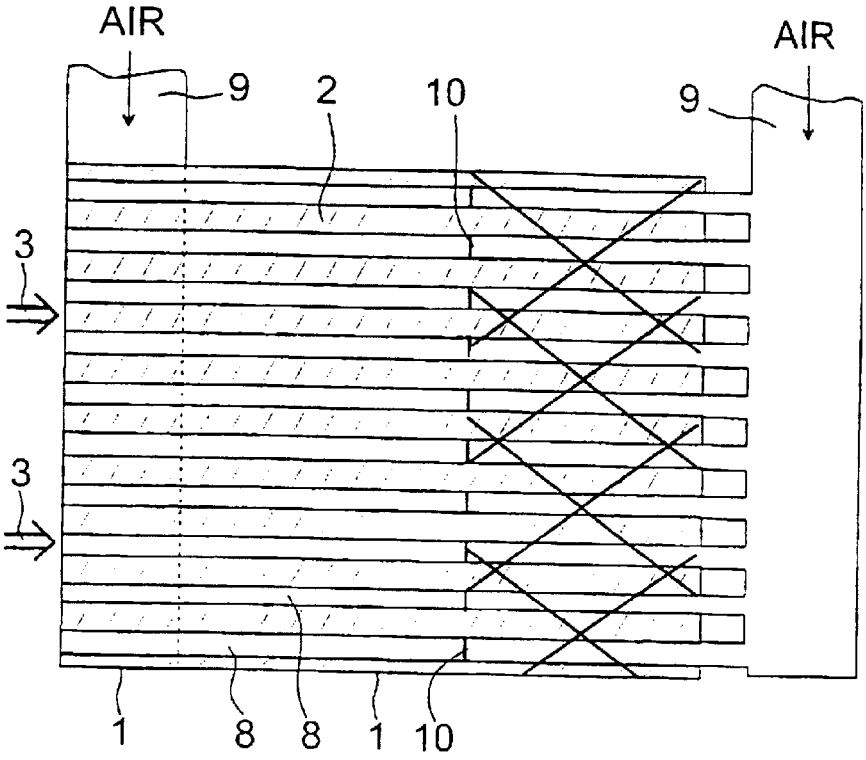
FIGS. 7 and 8 illustrate a third embodiment of the grate and its adjustment seen from above and from the side.
Figure 8:
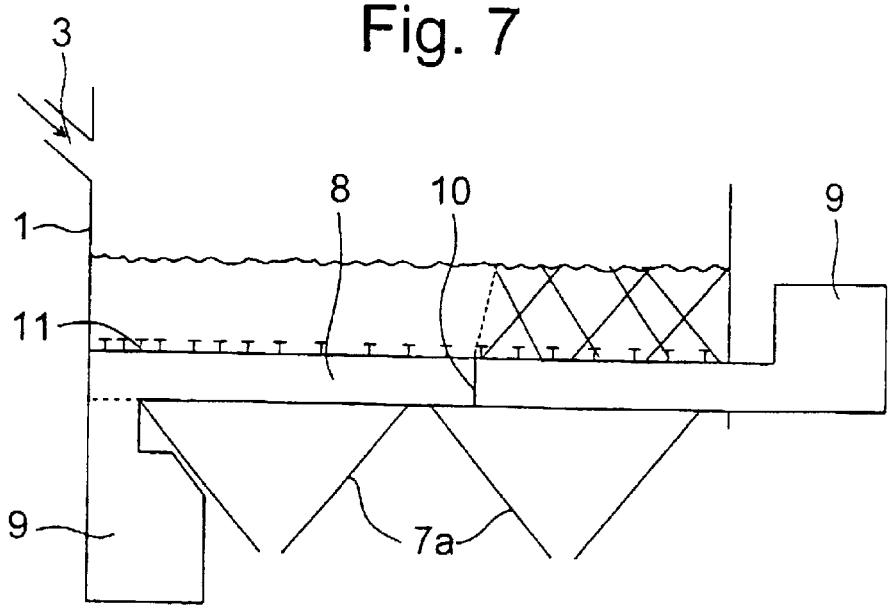

FIGS. 7 and 8 show another type of structural solution for the grate 2, for arranging the control. Thus, each pipe 8 of the grate 2 has a partition wall used as the control means 10. The partition wall is located in the area of the grate 2, i.e. underneath the fluidized bed, and it can be used to divide the grate 2 in two different sections in the longitudinal direction of the pipes. A transverse air duct 9 is connected to the pipes 8 at each end, wherein air can be supplied, if desired, from both ducts 9 or only from one duct. According to FIG. 7, the pipes 8 are divided by the control means 10 to a shorter and a longer section, and by shutting off air supply from the air duct 9 connected to the shorter section, it is possible to inactivate the smaller area marked with a diamond pattern and limited by a wall extending transversely to the longitudinal direction of the pipes 8. Furthermore, FIGS. 7 and 8 show how fuel is supplied in the direction of the pipes 8 from the chamber wall at the end of the longer sections of the pipes.

Figure 9:
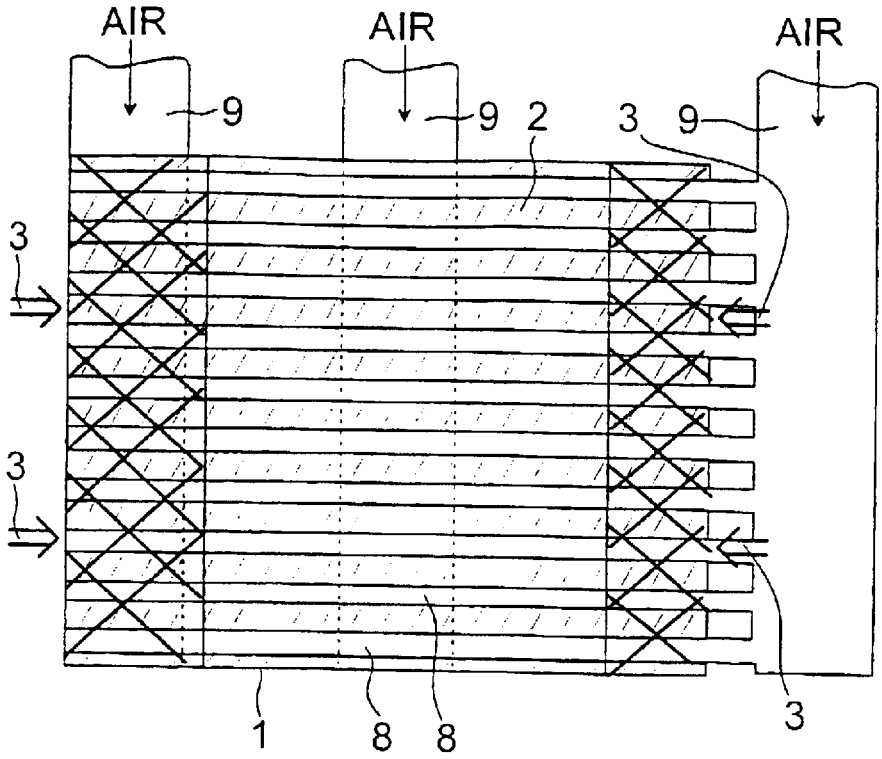
FIGS. 9 and 10 illustrate a fourth embodiment of the grate and its adjustment seen from above and from the side.
Figure 10:
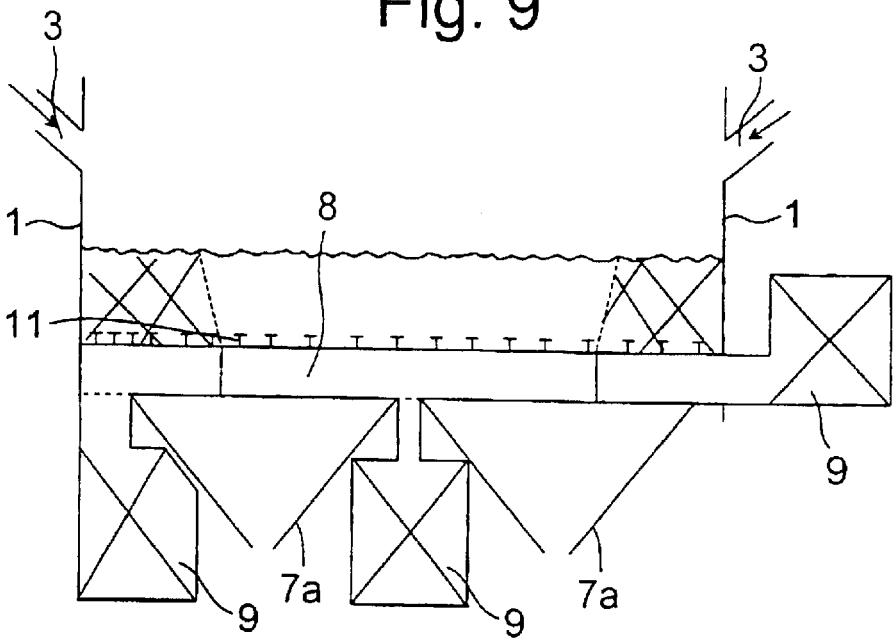

FIGS. 9 and 10, in turn, illustrate a further modification of the embodiment of FIGS. 7 and 8. The pipes 8 are divided each with two partition walls, or control means 10, to three parts, a separate transversely extending air duct 9 being in connection with each to distribute air to the pipes. The control means 10 are placed in the pipes close to the edges of the grate 2, that is, close to the end of the pipes so that a longer section is left in the centre than at the ends. A common air duct 9 extending underneath the grate 2 in a direction perpendicular to the pipes 8 is connected to the longer section. When the air flow to the air ducts 9 connected to the ends of the pipes is closed and a flow is left in the air duct 9 extending in the centre, the effective area of the grate can be reduced at both ends of the pipes. Thus, it is possible in the longitudinal direction of the pipes to arrange inactive areas limited by the chamber walls transverse to the longitudinal direction of the pipes at opposite ends of the grate; these areas are marked with a diamond pattern in FIG. 9. Naturally, it is possible to close the air flow to only one of the air ducts 9 at the end of the grate, wherein an inactive area is only formed in this part of the surface area of the grate. In the embodiment of FIGS. 9 and 10, the fuel is supplied from both ends of the grate 2, in the direction of the pipes 8, and there are two inlets in each chamber wall transverse to the longitudinal direction of the pipes.

The most advantageous solution is to provide several pipes 8 with a control means 10 that can be opened and closed, at least at the edges of the grate 2 (FIGS. 3 to 6), because the adjustment can thus be made one small area at a time according to the need, the minimum area being one pipe, and the width of the areas is not structurally predetermined as in the alternatives with the partition walls. In the solutions using control means 10 that can be opened and closed, the fuel is supplied from the inlets 3 in a direction transverse to the pipes, i.e. the area is reduced and increased in the direction of supplying the fuel (FIGS. 3 and 4). The same principle, i.e. the active area is increased and reduced in the direction of supplying the fuel, can also be seen in FIGS. 7 and 8. The area can also be adjusted in directions perpendicular to the direction of supplying the fuel, as indicated in FIGS. 5 and 6, and 9 and 10.

Also, a combination of the FIGS. 3 to 6 and 7 to 10 is possible. Thus, there is a partition wall in all pipes, and the number of air ducts 9 connected to the grate 2 corresponds to the number of compartments separated by the partition walls, as in FIGS. 7 to 10, but the pipes 8, at least the outermost ones, are also provided with closable control means 10 to prevent the flow from the air ducts 9. It is thus possible to close one or more edge pipes 2 totally by preventing the flow from those flow ducts 9 connected to the pipe, from which air is supplied to the grate to the pipes 8 in the middle.

Figure 11:
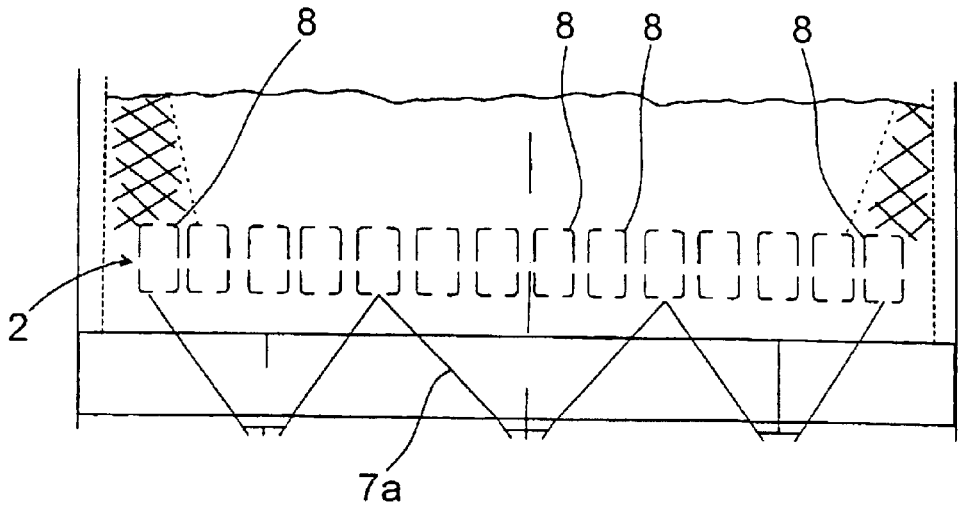
FIG. 11 illustrates the structure of the lower part of the fluidized bed boiler seen in the longitudinal direction of the pipes.

FIG. 11 shows the structure of the lower part of the fluidized bed boiler seen in the longitudinal direction of the pipes, and the parts therein are indicated with the same reference numbers as in the preceding figures. The solution in question has the same control principle as in FIG. 3, wherein one or more outermost pipes 8 at each edge of the grate are equipped with a separate control means 10. The figure shows a situation in which air supply to the outermost pipe at each edge is closed with a control means 10, wherein the non-active area formed next to the chamber wall is illustrated with a diamond pattern.

Figure 14:
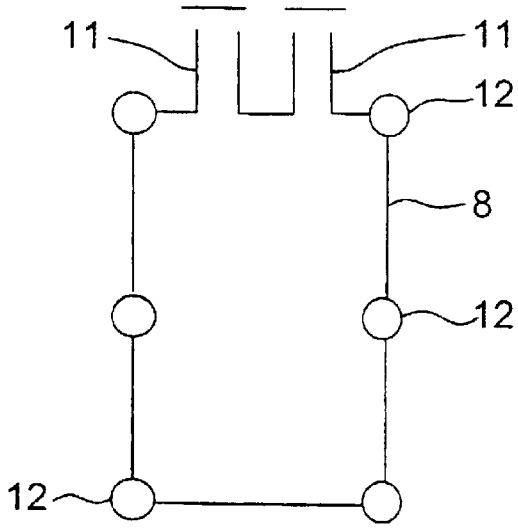
FIG. 14 shows one pipe of the grate in a cross-sectional view.
Figure 12:
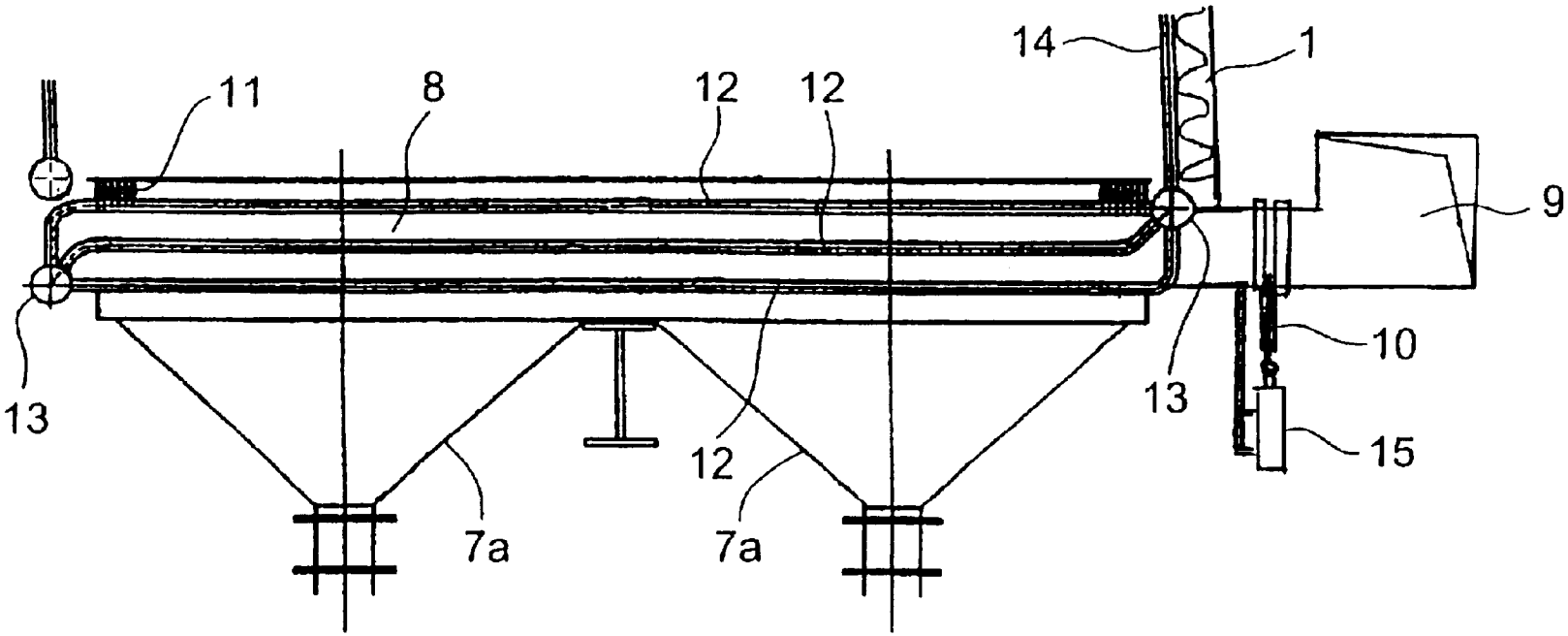
FIGS. 12 and 13 illustrate, in more detailed views, the structure of the grate in a direction perpendicular to the pipes, seen from the side.
Figure 13:
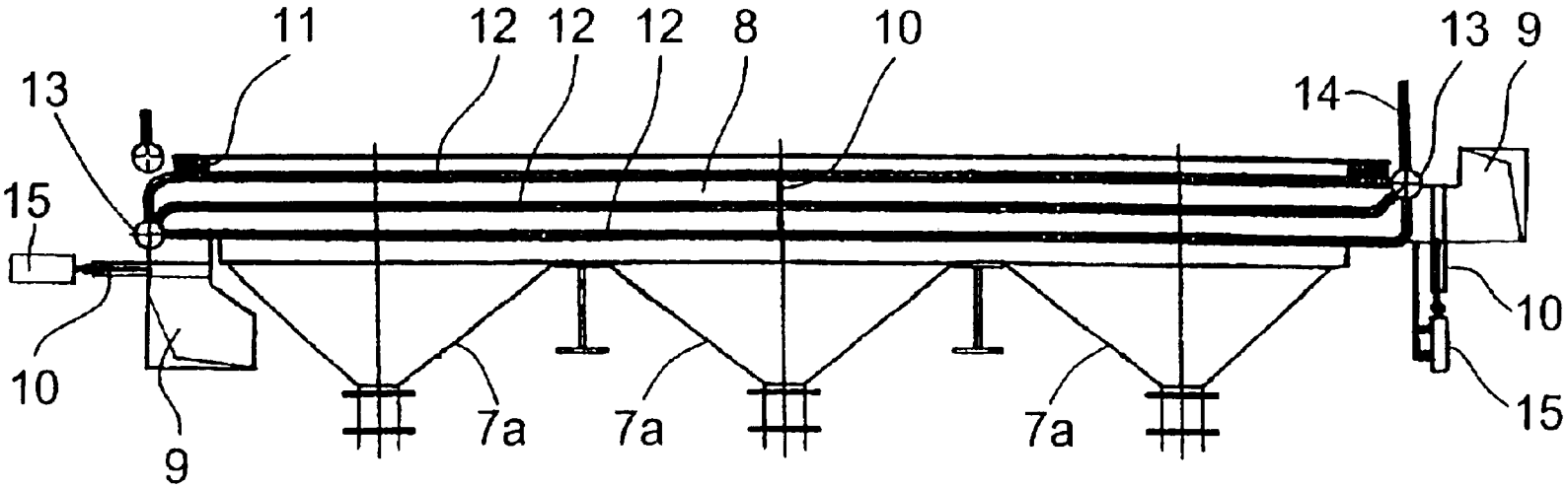

FIGS. 12 to 14 illustrate the structure of the pipes of the grate 2 in more detail. FIG. 12 shows the grate according to the embodiment of FIGS. 3 to 6 seen in a direction perpendicular to the longitudinal direction of the pipes, i.e. it shows one pipe 8 seen from the side. The sparge pipes 8 are equipped with a cooling medium circulation, for which purpose the walls of the pipes 8 enclosing an air duct through which air is supplied to the nozzles 11 are equipped with cooling medium channels 12. There are several tubular channels 12 extending in parallel along the sparge pipe 8, and they are joined at both ends of the sparge pipe to a manifold 13, of which the one on the right hand side in FIGS. 12 and 13 is further connected with tubes 14 on the furnace wall. The principle is that a cooling medium at a suitably low temperature flows from the left manifold 13 to the channels 12 and through the channels in the longitudinal direction of the sparge pipes 8, cooling the sparge pipe, and the heated medium is transferred to the tubes 14 on the furnace wall, acting there as a heat transfer medium to transfer combustion heat in a way known as such. The cooling medium used in the grate is normally a liquid medium, such as water. It is also possible to use a gaseous cooling medium, e.g. steam. The cooling medium can also be a mixture of water and steam.

Further, FIG. 12 shows a movable control means 10 which is placed at the right end of the sparge pipe 8, outside the furnace area, and which is a damper equipped with an actuator. The actuator 15 can be used to push the damper transversely to the pipe so that it covers the whole cross-sectional area of the pipe and thereby shuts off the flow from the air duct 9 to the pipe.

FIG. 13 shows the outermost pipe 8 of the pipe grate 2 comprising both a fixed control means 10 to divide the pipe in two successive compartments in its longitudinal direction and control means 10 which can be opened and closed and are disposed between the compartments and the respective air ducts 9. The pipes 8 in the middle of the grate 2 have fixed control means 10 only. The cooling medium circulation is arranged in the same way as in FIG. 12.

The alternative of FIG. 12 is best suitable for relatively small pipe grates (grate length less than 7.5 m in the direction of the pipes), and the alternative of FIG. 13, in which the pipes also have fixed partition walls, is suitable for larger grates (grate length more than 7.5 m in the direction of the pipes). Nevertheless, these values do not restrict the area of usage of the alternatives of the invention.

FIG. 14 shows a sparge pipe 8 of FIG. 12 or 13 in a cross-sectional view. Several channels 12 of the cooling medium circulation are placed in the walls of the sparge pipe 8 so that they are located at least in both side walls either approximately in the middle and/or in a corner. As shown in FIG. 13, the channels 12 are placed in the side walls of the sparge pipe 8, whose cross-sectional shape is an upright rectangle, so that one pipe is in the middle and one is at the upper edge and lower edge of the wall, i.e. in the corner point of the side wall and the upper wall, and of the side wall and the lower wall, respectively. Furthermore, the channels 12 are placed as a part of the wall of the sparge pipe 8 so that a portion of each channel 12 protrudes outwardly from the surface of the sparge pipe and, on the other hand, a part of its cross-section extends to the interior of the sparge pipe, i.e. towards the air flow duct limited by the walls. FIG. 14 also shows the structure of a nozzle 11. The nozzle 11 which conducts fluidizing and combustion air from the inside of the sparge pipe up to the furnace consists of a vertical pipe fixed at the upper surface of the sparge pipe, with a protective cap or the like placed in its upper part. The sparge pipes can also have other shapes than those shown in FIG. 14. Common to them is the closed cross-sectional form which encloses a flow duct for air or a corresponding gaseous medium, also the nozzles 11 opening up to the furnace being connected to the flow duct. With respect to the different structural alternatives for the pipes 8, reference is made to Finnish publication print 98405 and the corresponding U.S. Pat. No. 5,743,197.

The adjustment of air supply in a pipe-specific manner in sparge pipes equipped with a cooling medium circulation is particularly advantageous in that when air supply to one pipe or a part of its length is cut off, the pipe can be cooled with a cooling medium, wherein it is not heated in excess even if the cooling air flow is cut off.

In the use of the boiler, it should be noted that to prevent hardening of a bed area out of use, it is advantageous to conduct air also to the inactive area of the grate 2 at intervals, e.g. once a day. In this way, the bed material can be mixed with the active bed, and the accumulation of coarse material in the inactive area can be prevented.

The invention provides versatile control possibilities. If the control means closable by an actuator are used to turn the air flow to the pipe on and off, it is possible to equip a required number of pipes 8 at both edges of the grate 2 with this control possibility so that the middlemost sparge pipes 8 are always connected to the air flow. The proportion of the pipes at the edges equipped with this possibility depends on the scope of adjustment needed. The number of pipes equipped with a closable control means 10 is normally less than a half of the total number of the pipes, and they are preferably distributed in equal number on both sides of the grate 2. The number of closable pipes can be 10 to 25% of the total number of pipes in the pipe grate. It is, however, possible to equip all the pipes with a closing control means 10, if necessary.

When fixed partition walls are used as the control means 10, they are preferably located so that they limit an area of less than the half of the length of the pipes at one end of the grate. If two fixed control means 10 are used in each sparge pipe, the area limited in the middle, i.e. the area over which fluidizing and combustion air is always supplied to the furnace, is more than a half of the total area of the grate 2.

Air supply to the sparge pipes 8 of the grate 2 and the use of the control means 10 can be coupled to other automatic and control systems in the combustion plant, wherein it is possible continuously to control e.g. the area of the grate 2 surface in use, and to change the area e.g. by an operation in a control room upon a change in the conditions, e.g. the fuel.

The invention is suitable for both new and old fluidized bed boilers with a pipe grate. In old boilers, reconstruction can be easily implemented by equipping some of the pipes 9 with movable control means 10. The solution applying fixed partition walls requires more changes in an old grate, namely the fixing of partition walls in the pipes and possible additional air ducts 9.

What is claimed is:

1. A method for adjusting a supply of gaseous medium to a fluidized bed boiler performing a combustion process and including a pipe grate comprising a plurality of pipes, the method comprising:

adjusting an active area of the pipe grate to form at least one inactive bed area that is out of use by shutting off the supply of gaseous medium to some of the pipes of the pipe grate utilizing pipe-specific control means included in at least some of the pipes of the pipe grate; and conducting cooling medium through cooling channels located in the pipes in the at least one inactive bed area at least during the combustion process.

2. The method according to claim 1, wherein the gaseous medium is air.

3. The method according to claim 1, further comprising:

supplying fuel to the fluidized bed boiler in a direction perpendicular to the direction of the pipes.

4. The method according to claim 1, further comprising:

supplying fuel to the fluidized bed boiler in a direction parallel to the direction of the pipes.

5. The method according to claim 1, wherein the cooling medium is liquid or gaseous.

6. The method according to claim 5, wherein the cooling medium comprises at least one of water and steam.

7. A pipe grate for a fluidized bed boiler, the pipe grate comprising:

a plurality of pipes;

a duct connected to the pipes and operable to supply a gaseous medium to the pipe grate;

nozzles operable to supply the gaseous medium to a furnace above the pipe grate;

pipe-specific control means acting on at least some of the pipes in the pipe grate and being openable and closable to, respectively, open and close the connection from the duct to the pipes and operable by a closing action to shut off the supply of gaseous medium to at least some of the pipes to adjust an active area of the pipe grate and form at least one inactive bed area that is out of use wherein the control means are arranged in at least one outermost pipe at both edges of the pipe grate, wherein a number of pipes equipped with the openable and closable pipe-specific control means at edges of the pipe grate of parallel pipes is less than half of a total number of pipes of the pipe grate; and channels operable to conduct a cooling medium to at least some of the pipes to cool the at least one inactive bed area.

8. The pipe grate according to claim 7, further comprising:

fuel inlets that open in the furnace in a direction transverse to the direction of the pipes.

9. The pipe grate according to claim 7, further comprising:

fuel inlets that open in the furnace in substantially the same direction as the pipes.

10. The pipe grate according to claim 7, wherein the pipe-specific control means comprises a damper equipped with an actuator arranged to move the damper transversely to the pipe to a position where the damper covers a cross-sectional area of the pipe.

11. The pipe grate according to claim 7, wherein the pipe-specific control means is located between the duct and the pipe grate at an initial end of the pipes in a part that is outside the pipe grate.

12. The pipe grate according to claim 7, wherein the number of pipes equipped with the openable and closable pipe-specific control means at the edges of the pipe grate of parallel pipes is less 10 to 25% of the total number of the pipes of the pipe grate.

* * * * *